United States Patent [19]

Karlberger

[11] 4,084,797

[45] Apr. 18, 1978

[54] DEVICE INTENDED FOR CONTROLLED COOLING OR WIRE, ESPECIALLY STEEL WIRE

[75] Inventor: Walter Johann Karlberger, Smedjebacken, Sweden

[73] Assignee: Morgardshammar Aktiebolag, Smedjebacken, Sweden

[21] Appl. No.: 772,959

[22] Filed: Feb. 28, 1977

[30] Foreign Application Priority Data

Mar. 15, 1976 Sweden ..... 7603274

[51] Int. Cl.[2] ..... C21D 9/56

[52] U.S. Cl. ..... 266/106; 140/2; 148/153; 148/156

[58] Field of Search ..... 72/201; 140/2; 148/153, 148/156; 266/106

[56] References Cited

U.S. PATENT DOCUMENTS

| | | | |
|---|---|---|---|
| 3,390,871 | 7/1968 | McLean et al. | 266/106 X |
| 3,788,618 | 1/1974 | Van Den Bulcke | 266/106 X |

*Primary Examiner*—Roy Lake
*Assistant Examiner*—Paul A. Bell
*Attorney, Agent, or Firm*—Young & Thompson

[57] ABSTRACT

The present invention relates to a device for controlled cooling of wire, especially steel wire. According to the invention the device comprises, in combination, a movable conveyor to which wire is continuously supplied in open ring windings for movement of the same in mutually displaced positions, means surrounding the conveyor for control of the temperature ratios of the wire, and a collection device for the cooled ring windings, said conveyor essentially having the shape of an inclined plane which rotates about its center.

7 Claims, 2 Drawing Figures

DEVICE INTENDED FOR CONTROLLED COOLING OR WIRE, ESPECIALLY STEEL WIRE

For controlled cooling of wire, especially steel wire, it is previously known to arrange a guide tube after the rolling mill, said guide tube receiving and leading the wire to a coiler which shapes the wire to open, at least essentially stationary wire windings or wire coils which are thereafter moved in mutually displaced positions on a movable conveyor arranged beneath the coiler to a ring collector arranged at the output end of said conveyor, the conveyor being so designed that the open wire windings or wire coils conveyed on the same are sufficiently well supported so as not to be deformed and a are influenced to a satisfactory degree by a cooling gas which, for this purpose, has free access to the wire rings.

However, devices designed in this manner are weighed down by several essential disadvantages. Firstly, the movable conveyor must be of great length so that required controlled cooling shall be provided with ample time to take place and the desired material conversion in the wire shall be achieved. This results in both great production costs as well as serious restrictions as regards installation possibilities in existing spaces. Secondly, the previously known conveyor can only be used in connection with gaseous coolants, which is why it cannot be used in connection with a patenting of wire in which the warm wire is cooled by means of being immersed in a warm aqueous bath. If the known type of movable conveyor with its conveyor belt consisting of mutually linked parts is used in connection with warm aqueous baths, the linked parts would soon rust together. This is especially true as oil or fat cannot be tolerated in the aqueous bath as the fatty substances would jeopardize the actual patenting process.

The purpose of the present invention is to provide a device intended for cooling wire, especially steel wire, said device not being weighed down by the disadvantages and restrictions in use which are inherent in the known arrangement described above.

In order to accomplish this, the invention proposes a device which is primarily characterized in that it, in combination, comprises a movable conveyor to which wire is continuously fed in open ring windings for movement of the same in mutually displaced positions, means surrounding the conveyor for controlling the temperature ratios of the wire and a collecting device for the cooled ring windings, the conveyor essentially having the shape of an inclined plane which is rotatable around its center.

A device provided with these characteristics according to the invention can be provided with a compact design which allows for small construction height and furthermore merely requires a relatively restricted installation surface. It can also be easily arranged either for cooling with water or with gas and generally has great flexibility with respect to different cooling processes. At the same time, the advantages of a simple and operational mechanical construction have been gained in which no linked parts need to be lubricated or be made the subject of inspection under difficult conditions. The staying time of the treated wire in the device is the same for all of the wire windings and can furthermore be easily regulated merely by means of the rotation speed of the conveyor being altered. Furthermore, contrary to that which is the case in the device mentioned in the introduction above, the present device provides an even cooling of the entire wire windings.

In order to secure as little installation space as possible and as simple a construction as possible, the conveyor loading position is, in an especially suitable embodiment of the device, situated in connection with a device which is capable of continuously laying open wire rings onto the conveyor, for example, a coiler.

The means surrounding the conveyor for control of the temperature ratio of the wire can, in itself, be designed in different manners, but in an especially suitable embodiment of the invention, they comprise a fluid container in which the conveyor is movable. Furthermore, especially when great flexibility for different cooling processes is required, they should also comprise exhaust means for cooling fluid.

The collecting device for the cooled ring windings suitably comprises a take-up table, after which a wire ring collector is situated. A driven conveyor path is suitably arranged between said table and the wire ring collector in order to secure the correct forward feed of the cooled wire ring windings to the wire ring collector.

The removal table should preferably be designed as a scrape-off means for the carrying surface of the conveyor as this secures both a secure and correct removal of the wire windings and contributes to a simple and non-disturbanceprone embodiment of the device.

Suitably, the collecting device for the cooled ring windings is connected to the highest point of the movable conveyor, and the conveyor should have a perforated carrying surface in order that the wire ring windings conveyed by the conveyor shall be influenced by the coolant in as versatile a manner as possible. In order to expediate assembly and maintainance of the carrying surface of the conveyor, said surface should consist of segments of circles. The conveyor according to the invention receives its simplest design if it has the general shape of a carousel which runs in a container.

The invention shall be explained below with reference to an embodiment of the same shown in the enclosed drawing.

Figure 1:
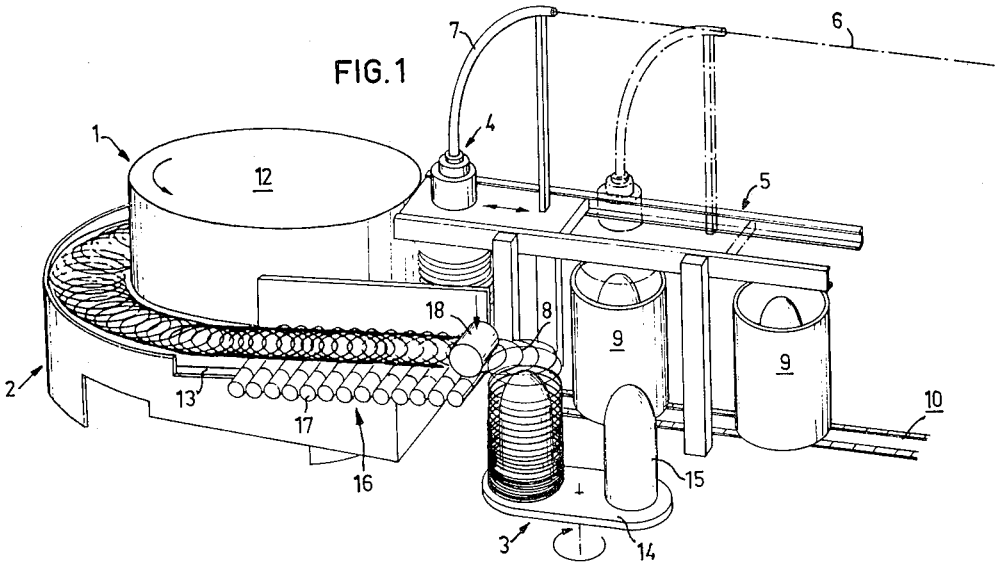
FIG. 1 is a schematic perspective view of a device designed according to the invention and placed in connection with a so-called Edenborn coiler.
Figure 2:
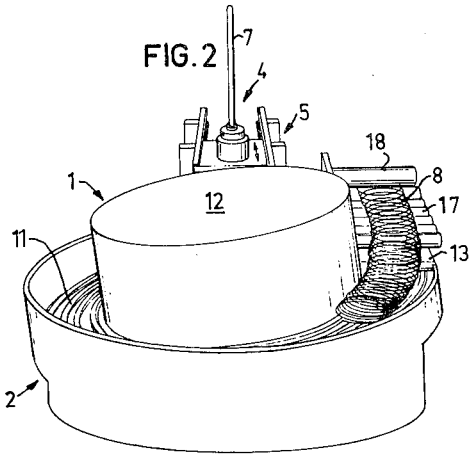
FIG. 2 is also a schematic perspective view revealing the appearance of said device as seen from the left in FIG. 1.

As can be seen in the drawing, a device arranged according to the invention comprises a combination of a movable conveyor 1, means 2 surrounding the same for control of the temperature ratios of the wire and a collecting device 3 for the cooled wire.

In the drawing, the devices shown placed in connection with a so-called Edenborn coiler 4 which, for example, can be arranged having a coiler head which is reciprocally movable in relation to the device according to the invention. In the shown example, the coiler 4 is arranged at least essentially horizontally movable in a reciprocal manner in a ramp construction 5, one end of which projects over the loading position of the conveyor 1. The wire 6 coming suitably from the final pair in a wire rolling mill is led to the coiler 4 by means of a guide tube 7, after which the coiler 4 continuously supplies the conveyor 1 with open ring windings or wire rings 8 at its loading station, said rings 8, as a result of the conveyor's movement, being laid onto and moved by said conveyor in mutually displaced positions in a manner illustrated in the drawing. As is indicated by broken lines in FIG. 1, the coiler 4, which can be moved in the ramp construction 5, can also be used for coiling open wire ring windings which can be deposited in heat-maintaining vessels 9 arranged beneath the ramp construction 5, said vessels being reciprocally movable in relation to their wire supply positions by means of some sort of suitable conveyor device, for example, the schematically indicated conventional conveyor belt 10 shown in FIG. 1.

In the device according to the invention as shown here, the coiler 4 is arranged on a sled which can be moved in the ramp construction 5, said sled being powered in a suitable arbitrary manner, for example, by means of a hydraulic cylinder which is not shown here. In its forward position which is indicated in the figure by solid lines, the sled is situated above the loading position of the conveyor 1 so that the coiler 4 then lays the open wire ring windings 8 directly onto the carrying surface of the conveyor. In the withdrawn position indicated by broken lines, the sled feeds wire ring windings to a heat-maintaining can 9. In both of the operational positions of the coiler 4, the sled should be able to be fixed in relation to the ramp construction 5, something which, for example, can be achieved by means of position-locking hydraulic clamping members which are not shown here.

As a result of its construction, the arrangement shown here is suitable to be used in connection with the Edenborn coiler 4 both for coiling in cooling liquid as well as for dry coiling without forced cooling and dry coiling with forced cooling, and — as has previously been mentioned — also for coiling in the heat-maintaining cans 9. Furthermore, other coiler arrangements than the one shown here can also be used.

According to the invention, the movable conveyor 1 essentially has the shape of an inclining plane 11 which is rotatable around its center. In the embodiment shown here, said plane 11 has the form of an inclining annular plane which projects radially outwards about the bottom portion of a central body 12 having a cylindrical casing so that said body 12 and the inclining annular plane 11 together have the appearance of a carousel whose rotary axis is inclined and in which the inclined annular plane 11 constitutes the carousel's or the conveyor's 1 carrying surface for the open wire ring windings 8. The inclined conveyor 1 feeds the wire windings 8 on said inclined plane or said carrying surface 11 from their loading position to the collecting arrangement 3 intended for the same and which is suitably situated in connection with the highest point of the conveyor. For this purpose, the carousel-like conveyor 1 composed of the central body 12 and the annular inclined plane 11 is arranged, for example, in a centrally-placed bearing (not shown here) powered by means of a hydraulic motor or electric motor attached to the underframe of the device, the outgoing axle of said motor being in gear engagement via a reduction gear with a tooth ring supported by the central body 11. Other arrangements for powering the conveyor 1 can, however, exist within the framework of the invention.

The annular plane or carrying surface 11 of the inclining conveyor is perforated and suitably consists of grid-like circle segments attached to the underframe of the central body 12, said segments being profiled, provided with slots and manufactured in cast iron.

In the embodiment of the invention shown here, the annular plane of the inclining conveyor 1 is intended to be up to approximately 7° to the horizontal plane. However, other angles of inclination can arise within the framework of the invention.

In the presently shown embodiment of the invention, the means 2 surrounding the conveyor 1 for control of the temperature ratios of the wire 6 essentially comprise a fluid container in which the inclining conveyor 1 is rotatable. Said fluid container consists of an annular groove having a U-shaped cross-section (not shown here) whose inner wall runs inside the central body 12 of the conveyor 1. Connections for the supply and removal of cooling liquid and arrangements for the supply of gaseous coolant for the cooling of the wire ring windings 8 situated on the conveyor's 1 carrying surface consisting of gride-like segments are arranged at the bottom of said container or groove. During the rotary movement of the conveyor 1, said wire ring windings 8 are either moved under the cooling liquid level in the annular groove or moved in the dry state in the same while being subjected to blowing of the gaseous coolant which, for this purpose, is blown up through the perforated carrying surface 11 of the conveyor, said carrying surface consisting of the grid segments. Achievement of the desired temperatures of the coolants and regulation of said temperatures can be effected in several different manners and is not the subject manner of the present invention.

The arrangement 3 intended for the collection of the cooled wire ring windings 8 essentially consists of a take-off table 13 after which a wire ring collector is situated, said collector comprising two central studs 15 arranged on a rotatable table 14. The cooled and open wire ring windings 8 deposited by the conveyor 1 are laid around said studs.

The take-off table 13 is situated in connection with the highest point of the path of the carrying surface 11 of the conveyor 1 and is designed as a scrape-off means for said carrying surface, for which purpose it consists of cast iron scrapers which partly go down between the grid profiles of the carrying surface 11 and partly are connected to the cylindrical central body 12 of the conveyor 1.

In order to expediate the removal of the wire ring windings 8 from the conveyor 1 by the take-off table 13, a powered conveyor path 16 is arranged between said table 13 and the wire ring collector 14, 15. In the present embodiment, the path 16 consists of a number of powered rollers 17 arranged after each other, and, suitably, an unpowered pneumatically-operated pressure roller 18 is placed above the terminal end of the path 16 so as to ensure that the wire ring winding 8 is correctly fed out so as to, by means of its own weight, fall down and lie horizontally over one of the central stubs 14 of the wire ring collector.

A suction device (not shown here) for steam andor gaseous coolant is suitably placed above the cooling fluid container 2 in which the conveyor 1 is movable.

The function of the device shown here will be described below in connection with coiling in water. The coiler head 4 is then in its position above the loading position of the conveyor 1. Suitably heated water is pumped into the fluid container 2 to a level which entails that the highest portion of the carrying surface 11 of the conveyor 1 lies above the surface of the water while the other parts lie below the same. After the rotary movement of the conveyor 1 has been started and set at a speed adapted to the rolling speed of the wire 6, the conveyor path 16 of the take-off table 13 is started, the peripheral speed of the rollers forming said path being brought into correspondance with the mean speed of the carrying surface 11 of the conveyor 1.

When coiling of the wire is thereafter started, the open wire windings fall into the water and lie on the carrying surface 11 of the conveyor 1 which continuously feeds the wire windings forwards along an approx. 225° circular path calculated from the loading position of the conveyor and up to that position at which each separate wire ring 8 leaves the water in order to shortly thereafter be taken up onto the take-off table 13 and further over the conveyor path 16 to the collecting arrangement 14, 15 for the cooled ring windings. During the last stage of each wire ring winding's stay on the conveyer path 16, they are held by the pressure roller 18 in a horizontal position until they fall down onto the wire ring collector's central stub 15.

When a complete wire ring has been completely coiled, the speed of the carrying surface 11 of the conveyor 1 and the rollers 17 of the powered conveyor path 16 is momentarily increased so that a separation is obtained between the different heated wire sections. When required separation is obtained, the speeds are reduced to their original rates and the device is prepared to receive new open wire ring windings 8 from the coiler 4.

If the device is used for dry coiling without forced cooling, no coolant is supplied to the fluid container 2. During dry coiling with forced cooling on the other hand, cooling air is blown up from the bottom of the fluid container 2 and through the perforated carrying surface 11 of the conveyor 1.

The invention is not restricted to the above-described embodiment which is also illustrated in the drawing. Rather, it can be modified in many ways within the framework of the claims.

I claim:

1. Device intended for controlled cooling of wire, especially steel wire, characterized in that said device, in combination, comprises a movable conveyor (1) to which wire (6) is continuously supplied in open ring windings (8) for movement of the same in mutually displaced positions, means (2) surrounding the conveyor for control of the temperature ratios of the wire and a collection device (3) for the cooled ring windings, said conveyor (1) essentially having the shape of an inclined plane (11) which rotates about its center.

2. Device according to claim 1, characterized in that the loading position of the conveyor (1) is situated in connection with a device (4,5) capable of continuously laying open wire rings (8) onto the conveyor, for example, a coiler.

3. Device according to claim 1, characterized in that the means (2) surrounding the conveyor (1) for control of the temperature rations of the wire comprises a fluid container in which the conveyor is movable.

4. Device according to claim 1, characterized in that the collection device (3) for the cooled ring windings (8) comprises a take-off table (13) after which a wire ring collector (14,15) is situated.

5. Device according to claim 4, characterized in that a powered conveyor path (16) is arranged between the take-off table (13) and the wire ring collector (14,15).

6. Device according to claim 1, characterized in that the collection device (3) for the cooled ring windings is situated in connection with the highest point of the movable conveyor (1).

7. Device according to claim 1, characterized in that the conveyor (1) essentially has the shape of a carousel (11,12) which runs in a container (2).

* * * * *